US007274797B2

(12) United States Patent
Hungerford

(10) Patent No.: US 7,274,797 B2
(45) Date of Patent: Sep. 25, 2007

(54) SPEAKER HOUSING

(75) Inventor: Paul A. Hungerford, Norman, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 535 days.

(21) Appl. No.: 10/618,918

(22) Filed: Jul. 14, 2003

(65) Prior Publication Data

US 2005/0013460 A1 Jan. 20, 2005

(51) Int. Cl.
*H04R 1/06* (2006.01)

(52) U.S. Cl. ..... 381/409; 381/394

(58) Field of Classification Search ..... 381/386, 381/433, 87, 332, 409, 389; 181/148, 171, 181/141, 150; 439/284, 289, 290, 652, 654, 439/649

See application file for complete search history.

(56) References Cited

U.S. PATENT DOCUMENTS 1,568,156 A * 1/1926 Herskovitz ..... 439/652
1,760,921 A * 6/1930 Strongson et al. ..... 439/652
6,457,547 B2 * 10/2002 Novitschitsch ..... 181/150
6,922,477 B1 * 7/2005 Ikeyama ..... 381/409

* cited by examiner

*Primary Examiner*—Sinh Tran
*Assistant Examiner*—Walter F Briney, III
(74) *Attorney, Agent, or Firm*—Brinks Hofer Gilson & Lione

(57) ABSTRACT

A speaker housing that includes an outer wall that has an upper wall point and a lower wall point. The outer wall forms an enclosure that is arranged in a predefined geometric shape that may match the shape of a loudspeaker that is installed in the speaker housing. The speaker housing also includes a mounting lip that extends inwardly a predetermined distance toward a central axis of the enclosure from approximately the upper wall point or from the upper wall point. A support member extends downwardly from an outer edge of the mounting lip to a motor assembly housing. A dual sided connector is formed on an outside surface of the outer wall that allows a clip to be connected to conductive leads in the dual sided connector from either side of the dual sided connector.

32 Claims, 4 Drawing Sheets

SPEAKER HOUSING

BACKGROUND OF THE INVENTION

1. Technical Field

This invention relates generally to speakers and, more particularly, to a speaker housing with a dual sided connector.

2. Related Art

A large amount of engineering has been placed in the design of dynamic loudspeakers and several different types of loudspeakers exist in various shapes, sizes and power ranges. A loudspeaker is a form of a transducer that converts electrical impulses into sound waves of sufficient volume to be heard by a number of listeners situated at some distance from the loudspeaker. Loudspeakers are often installed in various types of vehicles so that passengers of the vehicles can listen to music or other types of programming material while traveling to a destination.

A typical loudspeaker may include a voice coil that may be mounted so that it can move inside a constant magnetic field created by a permanent magnet that is included in the loudspeaker. A cone may be attached to the voice coil. The cone may also be attached with a flexible mounting to an outer ring of a speaker support. When electrical signals or impulses are supplied to the voice coil from an amplifier, the loudspeaker creates audible sounds.

At the present time, loudspeakers that are designed for use in various types of vehicles are designed to be either right or left hand speakers. When loudspeakers are installed in a vehicle they are typically installed on the right or left side of the vehicle. A speaker connection terminal included on each loudspeaker is configured for either the right or left side of the vehicle. When loudspeakers are designed to have speaker connection terminals that face either the right or left side, manufacturers are required to build two different speakers that have speaker connection terminals facing different directions even though all of the components of the loudspeakers otherwise remain the same. As such, a need exists for a loudspeaker assembly that has a speaker connection terminal that may be compatible for installation in either the right or left side of the vehicle without the need for manufacturing right and left hand speakers.

SUMMARY

The invention discloses a speaker housing that may be used to mount loudspeakers in a motor vehicle or any other place where loudspeakers may be placed for use in generating or producing audio sounds. The speaker housing may include a main housing wall having an upper wall point and a lower wall point that forms an enclosure or enclosed cavity having a central axis. The main housing wall may be formed generally in the same geometric shape as a loudspeaker for which the speaker housing will be used.

The main housing wall may also include an installation member and a speaker support or mounting lip. The installation member may be formed on an outside surface of the main housing wall and may extend outwardly a predetermined distance away from the central axis of the speaker housing. The installation member may be located at any point along the outside surface of the main housing. The installation member may also include a plurality of holes that may be used to secure the speaker housing in a structure in which the loudspeaker is being installed. The speaker support lip may be formed on an inside surface of the main housing wall and may extend inwardly a predetermined distance towards a central axis of the speaker housing.

The diameter or circumference of the main housing wall may be designed to encompass the loudspeaker and, as set forth above, may include the speaker support lip. A lip of a frame of the loudspeaker may be connected with the speaker support lip when the loudspeaker is installed in the speaker housing. The diameter or circumference of the main housing wall does not necessarily have to encompass the outermost point of the frame of the loudspeaker and may end at the beginning of the speaker support lip.

The speaker housing may also include at least one support member that extends downwardly from an edge of the speaker support lip to a motor assembly housing that is positioned within the inside diameter or circumference of the main housing wall. The support member may extend both downwardly and inwardly toward the central axis of the speaker housing to match the inward slope of the frame or a cone of the loudspeaker. The support members may include at least one housing aperture that may provide an air gap for apertures located in the frame of the loudspeaker. The apertures in the frame of the loudspeaker may provide an air gap between the interior and exterior of the frame. In other examples of the invention, the support members may be designed without apertures and there may also be no apertures in the frame of the loudspeaker.

The motor assembly housing may be formed to include a magnet housing and a back plate or center pole housing. The magnet housing may be formed in diameter or circumference somewhat larger than the diameter or circumference of a magnet of the loudspeaker. The back plate housing may also be designed somewhat larger in diameter or circumference than the diameter or circumference of a back plate of the loudspeaker. As such, a motor assembly of the loudspeaker will sit within the motor assembly housing of the speaker housing. In addition, the motor assembly housing may include a rear vent aperture that may allow air to flow in a rear vent of the loudspeaker, if the loudspeaker contains a respective rear vent.

The speaker housing may include a dual sided connector that may be formed on part of an outside surface of the main housing wall. In other examples of the invention, the dual sided connector may be formed as a separate piece that is connected with the outside surface of the main housing wall. The dual sided connector may include two connection points that are positioned at opposite ends of the dual sided connector. The connection points allow a clip electrically connected with the output of an amplifier to be removably connected with one of the connection points of the dual sided connector. The clip will be connected with conductive wires that are connected with an output from the amplifier that is used to drive the loudspeaker.

The clip may include a connection member that is connected with the conductive wires that carry the electric signals that are used to drive the loudspeaker. As such, the clip may have a positive and negative electric terminal that is connected with terminals inside the connection points of the dual sided connector. The clip may also include a locking mechanism or protrusion that may be designed to fit within a respective locking aperture of the dual sided connector. The locking aperture functions to hold the clip in place so that the clip does not inadvertently come unplugged from the dual sided connector because of vibration or possibly being bumped.

In another example of the invention, the speaker housing may include a pair of housing connection terminals that may extend upwardly from the mounting lip. The housing connection terminals may be connected with the two conductive leads that are located in the dual sided connector. The speaker housing may be molded from plastic or any other suitable material and each conductive lead may be connected with a respective housing connection terminal using any conventional method of connecting conductive materials together. In addition, each housing connection terminal and conductive lead may be formed as one piece of conductive material and may be molded in the speaker housing. In one example of the invention, the housing connection terminals may be connected with connection terminals of the loudspeaker. As such, an electrical connection may be established between the conductive leads of the dual sided connector and the loudspeaker.

In another example of the invention, the conductive leads may extend inwardly and extrude out into the inner diameter of the main housing wall of the speaker housing. Flexible conductors of the loudspeaker may be connected to a respective conductive lead of the dual sided connector where they protrude through the main housing wall. In this example, the loudspeaker may not include the connection terminals as the flexible conductors of the loudspeaker are connected directly with the conductive leads of the dual sided connector. The housing connection terminals may be used to secure the loudspeaker in the speaker housing.

The conductive leads of the dual sided connecter may extend to both sides of the dual sided connector. The conductive leads may be formed in a T-shape having one portion extending outwardly toward the central axis of the speaker housing. The conductive leads may extend through the main housing wall of the speaker housing to be exposed within an enclosed cavity that is created by the main housing wall. When the loudspeaker is installed in the speaker housing, the portions of the conductive leads that protrude through the main housing wall may be connected with the flexible conductive leads of the loudspeaker.

Another example of the invention discloses a loudspeaker assembly that includes a dual sided connector that eliminates the need for having left and right hand speakers for installation in motor vehicles. The loudspeaker assembly includes a loudspeaker that is positioned within a speaker housing. The lower portion of the lip of the frame may be positioned on top of the speaker support lip. In addition, the frame of the loudspeaker may be positioned on top of the support members of the speaker housing. The motor assembly of the loudspeaker may be positioned within a motor assembly housing of the speaker housing.

The flexible conductors of the loudspeaker are connected with the conductive leads of the dual sided connector. Since the dual sided connector contains two connections member that are positioned opposite each other on the outside of the speaker housing, the speaker assembly may be installed on any side of a motor vehicle or object for which it is intended for use. As such, the speaker assembly may be used for either right or left hand side loudspeakers thereby eliminating the need for the manufacture of separate loudspeakers that have connection terminals positioned on the right side and the left side of the loudspeaker.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
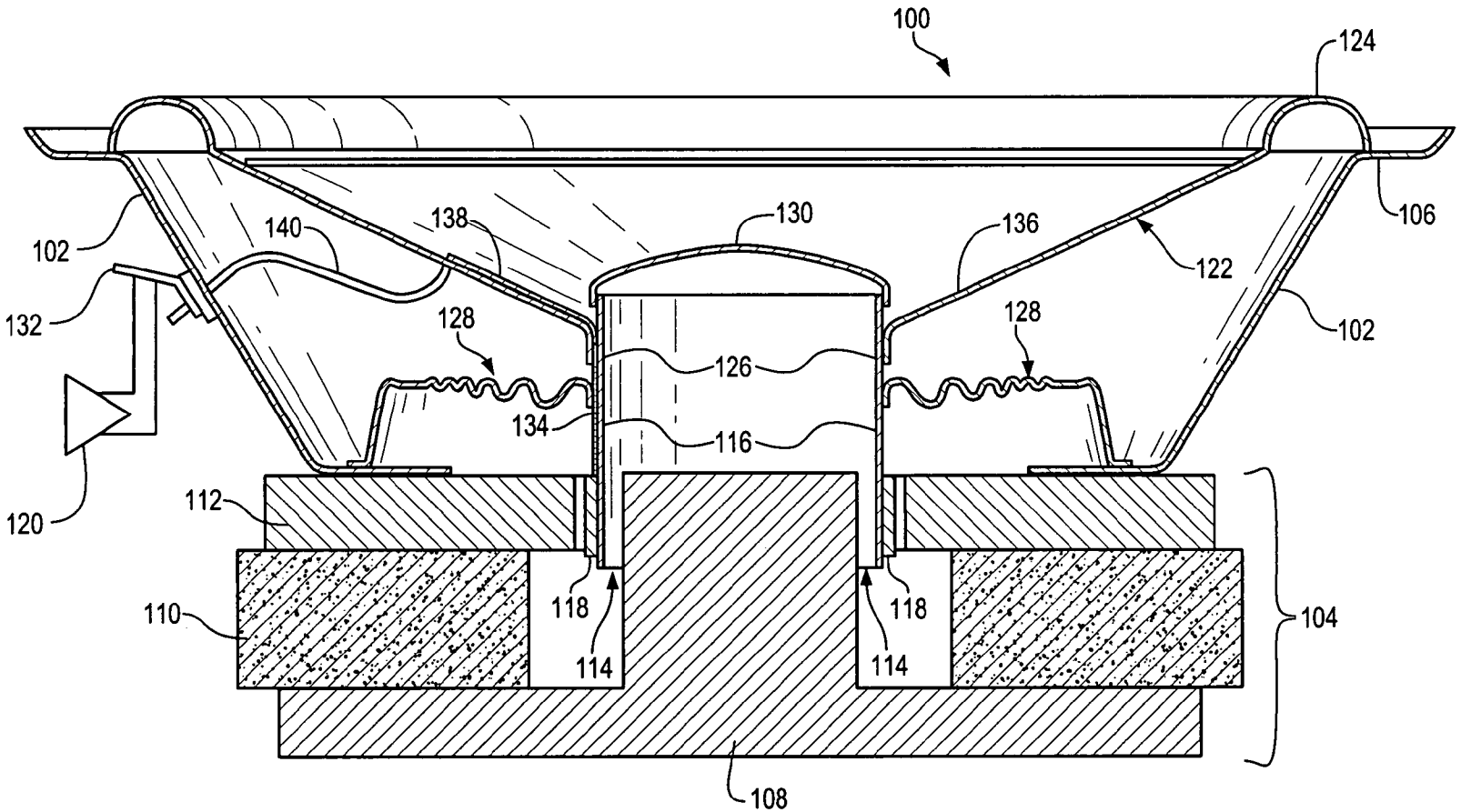
FIG. 1 is an example loudspeaker that may be mounted in the speaker housing.

In FIG. 1, a loudspeaker 100 is illustrated that may include a supporting frame 102 and a motor assembly 104. The frame 102 may include a lip 106 that extends outwardly from a main portion of the frame 102. The motor assembly 104 may include a back plate or center pole 108, a permanent magnet 110, and a front or top plate 112 that may provide a substantially uniform magnetic field across an air gap 114. A voice coil former 116 may support a voice coil 118 in the magnetic field. Generally speaking, during operation current from an amplifier 120 supplying electric signals representing program material to be transduced by the loudspeaker 100 drives the voice coil 118. The voice coil 118 may reciprocate causing it to reciprocate axially in the air gap 114. Reciprocation of the voice coil 118 in the air gap 114 generates sound representing the program material transduced by the loudspeaker 100.

The loudspeaker 100 may also include a cone 122. An apex of the cone 122 may be attached to an end of the voice coil former 116 lying outside the motor assembly 104. An outer end of the cone 122 may be coupled to a surround or compliance 124. The surround 124 may be attached at an outer perimeter to the frame 102. As set forth above, the frame 102 may also include the lip 106 that may be used to support mounting of the loudspeaker 100 in a desired location such as a surface or in a loudspeaker enclosure.

A spider 128 may be coupled at an outer perimeter of the spider 128 to the frame 102. The spider 128 may include a central opening 126 to which the voice coil former 116 is attached. A suspension including the surround 124 and the spider 128 may constrain the voice coil 118 to reciprocate axially in the air gap 114. In addition, the loudspeaker 100 may include a center cap or dust dome 130 that is designed to keep dust or other particulars out of the motor assembly 104.

The loudspeaker 100 may include a pair of loudspeaker terminals 132. The loudspeaker terminals 132 may provide a positive and negative terminal for the loudspeaker 100. A typical, although by no means the only, mechanism for completing the electrical connection between the loudspeaker terminals 132 and a pair of voice coil wires 134 is illustrated in FIG. 1. The voice coil wires 134 may be dressed against the side of the coil former 116, and pass through the central opening 126 and the intersection of the coil former 116 and the apex of the cone 122. In addition, the voice coil wires 130 may then be dressed across a face 136 of the cone 122 to a pair of connection points 138. At the pair of connection points 138, the voice coil wires 130 may be connected to a pair of flexible conductors 140. The flexible conductors 140 may be connected with the loudspeaker terminals 132. The pair of flexible conductors 140 may be made from tinsel, litz wire or any other suitable conductive material. The voice coil wires 130 may be fixed or attached to the face 136 of the cone 122 with an electrically non-conductive adhesive or any other suitable connection material.

The loudspeaker 100 set forth in FIG. 1 is illustrated with the frame 102, the cone 122, and the surround 124 formed in generally a circular shape. Different geometric loudspeaker shapes may also be used such as loudspeakers formed in the shape of squares, ovals, rectangles and so forth. As such, although the loudspeaker 100 is illustrated formed in generally a circular shape in FIG. 1, this should not be construed as a limitation of the invention unless specifically set forth in the claims set forth below. In addition, the components that are used to form the loudspeaker 100 set forth above should be viewed in an illustrative sense and not as a limitation. Other components may be used to make the loudspeaker 100.

Figure 2:
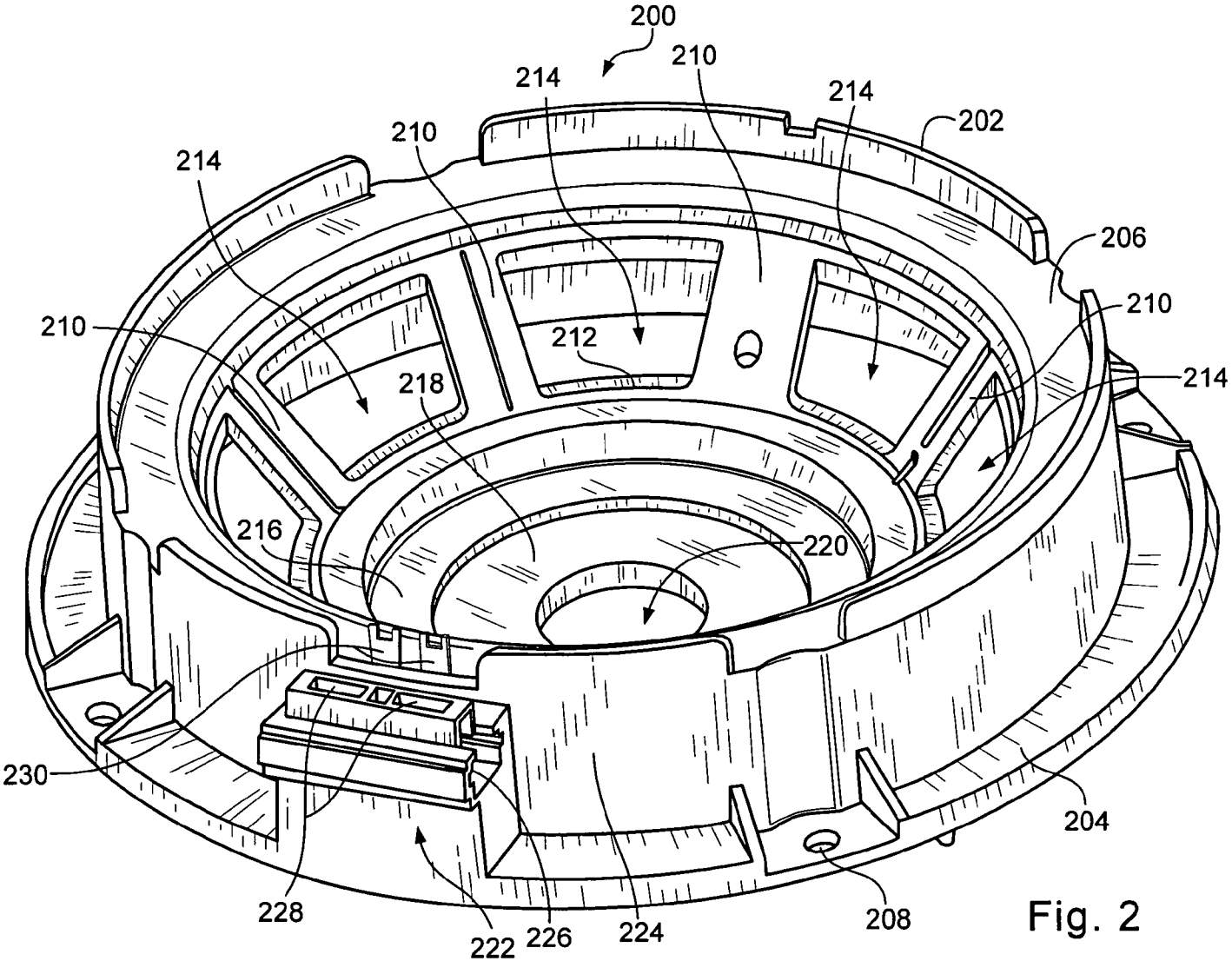
FIG. 2 is an example speaker housing.

In FIG. 2, a speaker housing 200 is illustrated that may be used to mount loudspeakers 100 in a motor vehicle or any other place where loudspeakers 100 may be installed for use in generating or producing audio sounds. The speaker housing 200 may be molded as one piece and may be made of plastic or any other material suitable for manufacturing the speaker housing 200. The speaker housing 200 may also be formed by connecting several pieces together to form the speaker housing 200 in a predetermined geometric shape such as a circle, rectangle, square, oval and so forth. The speaker housing 200 may be designed to receive the frame 102 or the cone 120 of the loudspeaker 100 that will be installed in the speaker housing 200. As set forth in greater detail in the sections that follow, the speaker housing 200 eliminates the need for manufacturing right and left hand loudspeakers through the use of a duel sided connector.

The speaker housing 200 may include a main housing wall 202 having an upper wall point and a lower wall point that forms an enclosure or enclosed cavity having a central axis. The main housing wall 202 may be formed in generally the same geometric shape as the loudspeaker 100, which may be any geometric shape such as a circle, rectangle, square, oval and so forth. The illustration of a circular shaped speaker housing 200 in FIG. 2 should not be construed as a limitation. Since the speaker housing 200 is designed to receive a loudspeaker 100, the shape of the speaker housing 200 may be designed to mimic the general shape of the loudspeaker 100.

The main housing wall 202 may include an installation member 204 and a speaker support lip or mounting lip 206. The installation member 204 may be formed on an outside surface of the main housing wall 202 and may extend outwardly a predetermined distance away from the central axis of the speaker housing 200. The installation member 204 may be located at any point along the outside surface of the main housing 202. The speaker support lip 206 may be formed on an inside surface of the main housing wall 202 and may extend inwardly a predetermined distance towards the central axis of the speaker housing 200.

As illustrated, the installation member 204 may extend outwardly from the outside surface of the main housing wall 202 to a predetermined distance at a predetermined angle in relation to the main housing wall 202. In other examples, the installation member 204 may be connected with the outside surface of the main housing wall 202 if the installation member 204 is made as a separate piece. The installation member 204 may also include a plurality of holes or mounting apertures 208. The mounting apertures 208 may be used to secure the speaker housing 200 to a location or structure in which the loudspeaker 100 is being installed. The speaker housing 200 may be connected in the object for which the loudspeaker 100 is to be used with any conventional connection device such as screws, bolts, rivets, glue, epoxy and so forth.

In FIGS. 1 and 2, the diameter or circumference of the main housing wall 202 may be designed to encompass the loudspeaker 100 and, as set forth above, may include the speaker support lip 206. The lip 126 of the frame 102 of the loudspeaker 100 may be connected with or rest in the speaker support lip 206 when the loudspeaker 100 is installed in the speaker housing 200. The diameter or circumference of the main housing wall 202 does not necessarily have to encompass the outermost point of the frame 102 of the loudspeaker 100 and may end at the beginning of the support lip or mounting lip 206. The speaker support lip 206 may be designed to extend inwardly from the main housing wall 202 a predetermined distance towards the central axis of the speaker housing 200. The speaker support lip 206 may also extend at a downward angle toward the central axis.

The speaker housing 200 may also include at least one support member 210 that extends downwardly to a motor assembly housing 212. The motor assembly housing 212 is positioned within the inside diameter or circumference of the main housing wall 202. The support member 210 may extend both downwardly and inwardly toward the central axis of the speaker housing 200 to match the inward slope of the frame 102 or cone 122 of the loudspeaker 100. The support member 210 may include at least one housing aperture 214 that, although not illustrated in FIG. 1, may provide an air gap between apertures (not illustrated) located in the frame 102 of the loudspeaker 100. The apertures in the frame 102 of the loudspeakers 100 may provide an air gap between the interior and exterior of the frame 102 and the cone 122. The support members 210 may also be designed without apertures and there may also be no apertures in the frame 102 of the loudspeaker 100. In FIG. 2, the housing apertures 214 are formed in the shape of a trapezoid, but other geometric shapes may be used such as circles, ovals, squares, rectangles and so forth The motor assembly housing 212 may be formed to include a magnet housing 216 and a back plate or center pole housing 218. The magnet housing 216 may be formed in a diameter or circumference somewhat larger than the diameter or circumference of the magnet 110 of the loudspeaker 100. The back plate housing 218 may also be formed somewhat larger in diameter or circumference than the diameter or circumference of the back plate 108 of the loudspeaker 100. As such, the motor assembly 104 of the loudspeaker 100 will sit within the motor assembly housing 212 of the speaker housing 200. In addition, the motor assembly housing 212 may include a rear vent aperture 220 that may allow air to flow in a rear vent (not illustrated in FIG. 1) of the loudspeaker 100, if the loudspeaker 100 contains a respective rear vent.

The speaker housing 200 may include a dual sided connector 222. The dual sided connector 222 may be formed on part of an outside surface 224 of the main housing wall 202. In other examples of the invention, the dual sided connector 222 may be formed as a separate piece that is connected with the outside surface 224 of the main housing wall 202. The dual sided connector 222 illustrated in FIG. 2 includes two connection members 226 that are positioned at opposite ends of the dual sided connector 222. The connection members 226 allow a clip (not illustrated) to be removably connected with the dual sided connector 222. The clip may be connected with conductive wires that are connected with outputs from the amplifier 120 that is used to drive the loudspeaker 100. The conductive wires include a positive conductive wire and a negative conductive wire.

An amplifier 120 output clip may include a clip connection member that may be connected with the conductive wires from the amplifier 120 that carry the electric signals that are used to drive the loudspeaker 100. As such, the clip may have a positive and negative electric terminal that is connected with terminals 304 (see FIG. 3) inside the connection members 226 of the dual sided connector 222. The clip may a T-shaped clip and include a locking mechanism or protrusion that may be designed to fit within a respective locking aperture 228 of the dual sided connector 222. The locking aperture 228 functions to hold the clip in place so that the clip does not inadvertently come unplugged from the dual sided connector 222 because of vibration or possibly being bumped.

Figure 3:
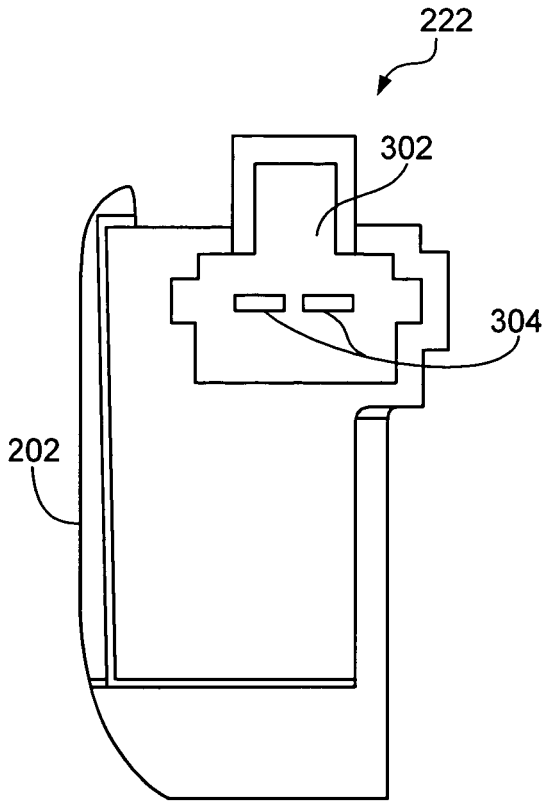
FIG. 3 is an example end view of one side of the dual sided connector of the speaker housing.

In FIG. 3, an end view of one side of the dual sided connector 222 that shows one of the connectors is illustrated. A connection member 226 may comprise a T-shaped cavity 302 that extends inside the dual sided connector 222 to a predetermined depth. In addition, the connection member 226 may include at least two conductive leads 304 that are used to transfer electric signals to the loudspeaker 100. The two conductive leads 304 represent positive and negative connection terminals that are formed to extend through the dual sided connector 222. The two conductive leads 304 extend to both sides of the dual sided connector 222 thereby allowing the clip that is connected to the dual sided connector 222 to be connected to either the first or second connection member 226. The dual sided connector 222 of the speaker housing 200 eliminates the need for manufacturing loudspeakers to be configured with right and left side loudspeaker terminals as the clip that supplies electric signals from the amplifier 120 may be connected to either side of the dual sided connector 222.

In FIG. 2, the speaker housing 200 may also include a pair of housing connection terminals 230 that may extend upwardly from the mounting lip 206. The housing connection terminals 230 may be connected with the two conductive leads 304 that are located in the dual sided connector 222. The speaker housing 200 may be molded from plastic or any other suitable material and each conductive lead 304 may be connected with a respective housing connection terminal 228 using any conventional method of connecting conductive materials together. Alternatively, each housing connection terminal 230 and conductive lead 304 may be formed as one piece of conductive material that may be molded in the speaker housing 200. In one example of the invention, the housing connection terminals 230 may be connected with the connection terminals 132 of the loudspeaker 100. As such, an electrical connection may be established between the conductive leads 304 of the dual sided connector 222 and the loudspeaker 100.

Figure 4:
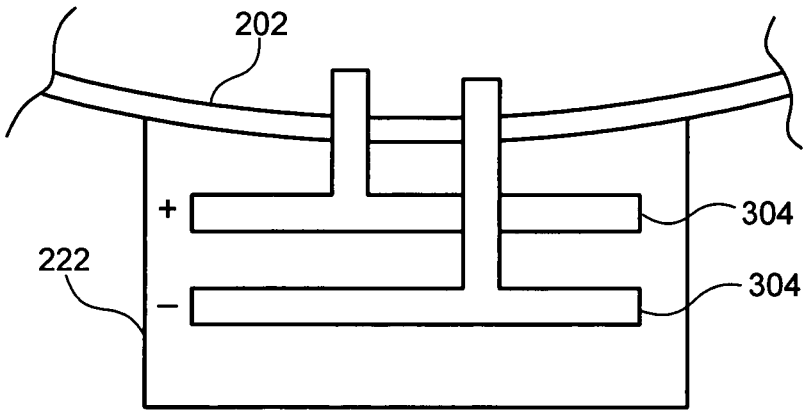
FIG. 4 is an example cross sectional view of a portion of the main housing wall that includes the dual sided connector.

In another example of the invention, illustrated in FIG. 4, the conductive leads 304 may extend inwardly and extrude out into the inner diameter of the main housing wall 202 of the speaker housing 200. The flexible conductors 140 of the loudspeaker 100 may be connected directly with a respective conductive lead 304 of the dual sided connector 222. In this example, the loudspeaker 100 may not include the connection terminals 132 as the flexible conductors 140 of the loudspeaker 100 are connected directly with the conductive leads of the dual sided connector 222. The housing connection terminals 230 may be used to secure the loudspeaker 100 in the speaker housing by a friction fit or any other method of connecting objection together.

FIG. 4 is an example cross sectional view of a portion of the main housing wall 202 that includes an illustrative version of the dual sided connector 222. The conductive leads 304 of the dual sided connecter 222 extend to both sides of the dual sided connector 222. In this example, the conductive leads 304 are formed in a T-shape having one portion extending outwardly toward the central axis of the speaker housing 200. The conductive leads 304 may extend through the main housing wall 202 of the speaker housing 200 to be exposed within the enclosed cavity that is created by the main housing wall 202. The conductive leads 304 may be formed in other shapes and the illustration of a T-shaped conductive lead 304 should be viewed in an illustrative sense. When the loudspeaker 100 is installed in the speaker housing 200, the portions of the conductive leads 304 that protrude through the main housing wall 202 may be connected with the flexible conductive leads 140 of the loudspeaker 100.

Figure 5:
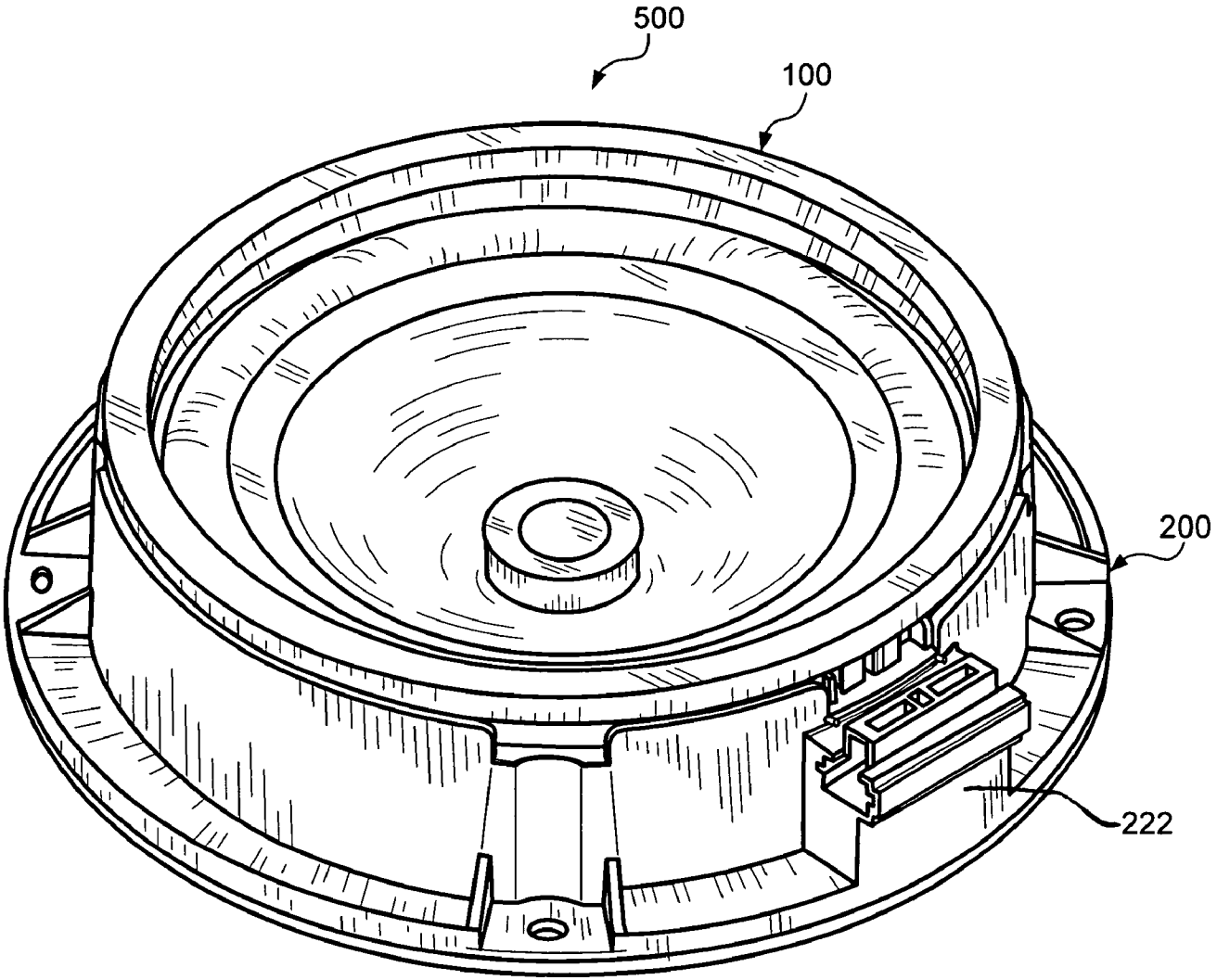
FIG. 5 is a perspective view of an example loudspeaker assembly that includes an illustrative loudspeaker installed in the speaker housing.

In FIG. 5, a loudspeaker assembly 500 is illustrated that includes a dual sided connector 222 that eliminates the need for having left and right hand speakers for installation in motor vehicles. The loudspeaker assembly 500 includes a loudspeaker 100 that is positioned within a speaker housing 200. Although not illustrated in FIG. 5, the lower portion of the lip 126 of the frame 102 may be positioned on top of the speaker support lip 206. In addition, the frame 102 of the loudspeaker 100 may be positioned on top of the support members 210 of the speaker housing 200. The motor assembly 106 of the loudspeaker 100 may be positioned within the motor assembly housing 212 of the speaker housing 200.

As previously discussed, although the speaker assembly 500 set forth in FIG. 5 is circular shaped, the speaker assembly 500 may be formed in any shape that matches the general shape of the loudspeaker 100 that is to be installed in the speaker housing 200. The loudspeaker 100 and the speaker housing 200 may be formed in a rectangular shape, a square shape, an oval shape and so forth. The flexible conductors 140 of the loudspeaker 100 are connected with the conductive leads 304 of the dual sided connector 222. Since the dual sided connector 222 contains two connection members 226 that are positioned opposite each other on the outside of the speaker housing 200, the speaker assembly 400 may be installed on any side of a motor vehicle or object for which it is intended for use. As such, the speaker assembly 400 may be used for either right or left hand side loudspeakers thereby eliminating the need for the manufacture of separate loudspeakers that have connection terminals positioned on the right side and the left side.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A speaker housing comprising:

a main housing wall forming an enclosed cavity;

a mounting lip extending inside the enclosed cavity;

a support member extending downwardly from the mounting lip;

a motor assembly housing connected to the support member; and a dual sided connector with oppositely facing side inputs located on an outside surface of the main housing wall.

2. The speaker housing of claim 1 further comprising an installation member extending outwardly from the enclosed cavity.

3. The speaker housing of claim 2 further comprising at least one mounting aperture in the installation member.

4. The speaker housing of claim 1 where the support member includes a plurality of apertures.

5. The speaker housing of claim 1 where the motor assembly includes a loudspeaker magnet housing.

6. The speaker housing of claim 1 where the motor assembly includes a loudspeaker back plate housing.

7. The speaker housing of claim 6 where the back plate housing includes a rear vent aperture.

8. The speaker housing of claim 1 where the dual sided connector includes at least two connection members, one for each of the inputs.

9. The speaker housing of claim 8 where each of the connection members include a cavity that extends inwardly a predetermined distance inside the dual sided connector.

10. The speaker housing of claim 8 where each of the connection members include at least two conductive leads that extend to both sides of the dual sided connector.

11. The speaker housing of claim 10 where each of the conductive leads extend a predetermined distance outside the main housing wall toward the inside of the enclosed cavity.

12. A speaker housing comprising:

a main housing wall forming an enclosed cavity;

a mounting lip extending inside the enclosed cavity;

a support member extending downwardly from the mounting lip;

a motor assembly housing connected to the support member; and a dual sided connector located on the outside surface of the main housing wall, where the dual sided connector includes at least two connector members, where each of the connector members include at least two conductive leads that extend to both sides of the dual sided connector, where each of the conductive leads extends upwardly a predetermined distance outside of the mounting lip.

13. A speaker housing comprising:

a main housing wall having an upper wall point and a lower wall point, the main housing wall forming an enclosed cavity having a predefined geometric shape;

a mounting lip extending inwardly a predetermined distance toward a central axis of the enclosed cavity, where the mounting lip extends inwardly from the upper wall point;

a support member extending downwardly from an outer edge of the mounting lip for connection with a motor assembly housing; and a duel sided connector formed on an outside surface of the main housing wall with side inputs, one facing rightwardly and one facing leftwardly from the main speaker housing.

14. The speaker housing of claim 13 further comprising an installation member extending outwardly a second predetermined distance away from the central axis of the enclosed cavity, where the installation member extends away beginning at about the lower wall point.

15. The speaker housing of claim 14 further comprising at least one mounting aperture in the installation member.

16. The speaker housing of claim 13 where the support member includes a plurality of apertures.

17. The speaker housing of claim 13 where the motor assembly housing includes a loudspeaker magnet housing.

18. The speaker housing of claim 13 where the motor assembly housing includes a loudspeaker back plate housing.

19. The speaker housing of claim 18 where the back plate housing includes a rear vent aperture.

20. The speaker housing of claim 13 where the dual sided connector includes a first connection member for its rightwardly facing input and a second connection member for its leftwardly facing input.

21. The speaker housing of claim 20 where each of the first and second connection members include a cavity that extends inwardly a predetermined distance from opposite sides of the dual sided connector.

22. The speaker housing of claim 20 where each of the first and second connection members share at least two conductive leads that extend to both sides of the dual sided connector.

23. The speaker housing of claim 22 where each of the at least two conductive leads extend a predetermined distance outside the main housing wall toward the central axis.

24. A speaker housing comprising:

a main housing wall having an upper wall point and a lower wall point, the main housing wall forming an enclosed cavity having a predefined geometric shape;

a mounting lip extending inwardly a predetermined distance toward a central axis of the enclosed cavity, where the mounting lip extends inwardly from the upper wall point;

a support member extending downwardly from an outer edge of the mounting lip connected to a motor assembly housing; and a dual sided connector formed on an outside surface of the main housing wall, where the dual sided connector includes a first connection member and a second connection member, where each of the first and second connection members share at least two conductive leads that extend to both sides of the dual sided connector, where each of the at least two conductive leads extend upwardly a predetermined distance outside the mounting lip.

25. A speaker housing comprising:

means for housing a speaker in an enclosed cavity;

means, extending inside the housing means, for mounting a lip of the speaker;

means, extending downwardly from the mounting means, for supporting a motor assembly housing; and means, attached to an outside surface of the housing means, for inputting speaker signals from opposite directions.

26. The speaker housing of claim 25 where the housing means comprises a main housing wall having an upper wall point and a lower wall point.

27. The speaker housing of claim 25 where the mounting means comprises a mounting lip extending inwardly a predetermined distance toward the central axis of the enclosed cavity.

28. The speaker housing of claim 25 where the support means comprises a support member extending downwardly from an outer edge of the mounting means to the motor assembly housing.

29. The speaker housing of claim 25 where the connection means comprises a dual sided connector that includes at least two connection members having conductive leads extending across both sides of the dual sided connector.

30. A speaker assembly comprising:

a speaker housing including a main housing wall, a mounting lip, a support member, a motor assembly housing and a dual sided connector;

a loudspeaker including a frame having a lip, motor assembly and a pair of flexible conductive leads;

where the lip of the frame of the loudspeaker is positioned in the motor assembly housing of the speaker housing; and where the dual sided connector has a first side input and a second side input, said first side input and second side input facing in opposite directions outside of the speaker housing, where the dual sided connector includes a pair of conductive leads that are connected to the pair of flexible conductive leads of the loudspeaker, where the pair of conductive leads extend to the first side input and the second side input of the dual sided connector.

31. A speaker assembly having a loudspeaker installed in a speaker housing comprising:

means for supporting a lip of a frame of the loudspeaker with a main housing wall included in the speaker housing;

means for supporting a motor assembly included in the loudspeaker within the main housing wall of the speaker housing; and means for inputting speaker signals from opposite directions outside of the speaker housing.

32. A speaker housing comprising:

a housing wall;

a dual sided connector having a first input connector and a second input connector at opposite sides of the dual sided connector outside of the speaker housing; and where either of the first and second connectors is configured to receive an amplifier output clip.

* * * * *